United States Patent [19]

Chao

[11] Patent Number: 4,574,579

[45] Date of Patent: Mar. 11, 1986

[54] ONE PROCESS TWIST AND PLY TWIST YARN SPINNING

[76] Inventor: Sing N. Chao, 7 Lane 101, Kienkwo South Rd., Sec. 1, Taipei, Taiwan, Taiwan

[21] Appl. No.: 577,512

[22] Filed: Feb. 6, 1984

[30] Foreign Application Priority Data

Feb. 7, 1983 [GB] United Kingdom ..... 8303290

[51] Int. Cl.[4] ..... D02G 3/28

[52] U.S. Cl. ..... 57/328; 57/236

[58] Field of Search ..... 57/243, 244, 245, 246, 57/328, 331, 285, 236, 238, 282, 284, 315, 351

[56] References Cited

U.S. PATENT DOCUMENTS

| | | | |
|---|---|---|---|
| 2,676,384 | 4/1954 | Reinhardt | 57/239 X |
| 2,810,949 | 10/1957 | Silver | 57/239 X |
| 3,802,174 | 4/1974 | Landwehrkamp et al. | 57/329 X |
| 3,831,368 | 8/1974 | Glowacki | 57/239 |
| 4,219,998 | 9/1980 | Farnhill | 57/328 X |
| 4,276,740 | 7/1981 | Chambley et al. | 57/328 X |
| 4,484,436 | 11/1984 | Nakayama et al. | 57/328 |

*Primary Examiner*—Donald Watkins

[57] ABSTRACT

A method for producing a twist ply yarn having two strands with the same twist direction and twist intensity includes the steps of false twisting each of two strands to produce a twist in a first direction upstream of the false twister and in the opposite direction downstream of the false twister, removing the twist in the strands downstream from the false twister and twisting the two strands together.

6 Claims, 5 Drawing Figures

ONE PROCESS TWIST AND PLY TWIST YARN SPINNING

This invention relates to a one step twist and ply twist yarn spinning.

It is well known to produce a single yarn from two separate rovings or fibre strands fed side by side through the same drafting mechanism. Such yarns are, however, quite different from two separate single twist yarns that are twisted together as so called twofold yarns in that, there is theoretically no twist in the individual strands since there is substantially only the plying twist.

The present invention is directed to the concept of providing a device which makes it possible to produce a product having substantially equal quality to that of the conventional ply twisted yarn.

The method of the present invention is characterized in that the actual twist that exists upstream of the fibre strand that produced by the false twist means is utilized. In this case it is different from the prior publications of G.B. 1,121,942 (Comm. Sc. & Ind.), G.B. 1,318,413 (Comm. Sc. & Ind.), G.B. 1,337,048 (Platt) and E.P. 0,038,143 (Toray).

The embodiment of the invention will now be described with reference to the accompanying drawing, in which:

FIG. 1*a* is a perspective view of the apparatus of the invention showing a spinning spindle fed with two fibre strands emanating from a pair of front rollers and passing through two-false-twist-tubes illustrating the principle of the invention except the arrow like top of the spindle is not shown.

FIG. 1*b* is a perspective view to show that the two fibre strands may be delivered from front rollers having separate sections.

Figure 1A:
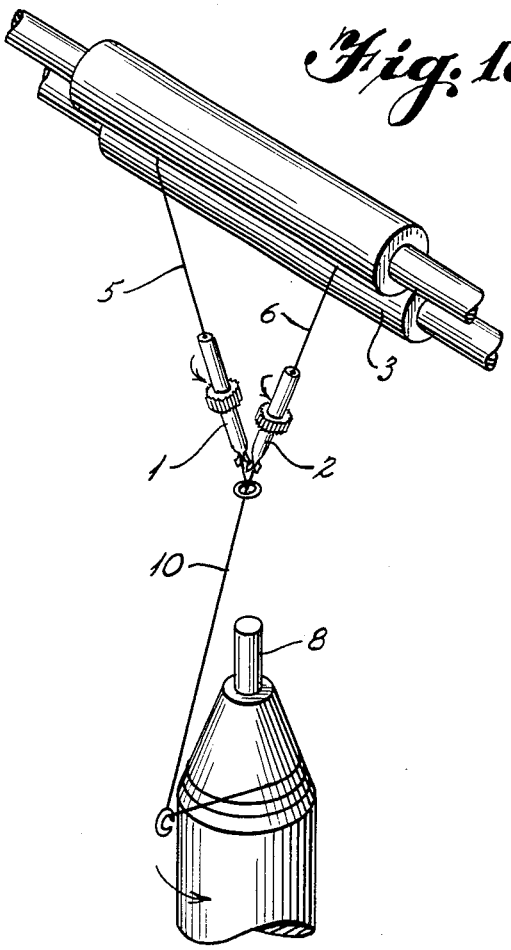
Figure 1B:
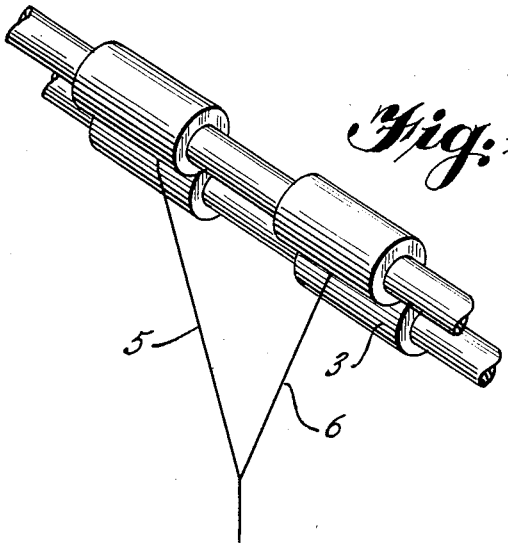
Figure 2:
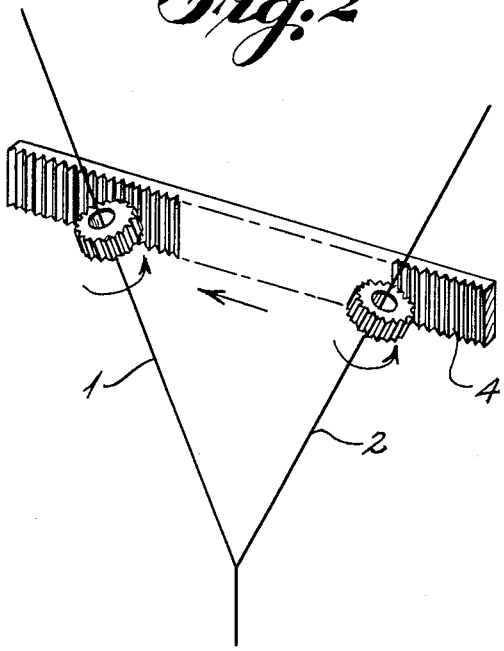
FIG. 2 is a perspective view of a section of one type of the driving mechanism for the false-twist-tubes.

This invention uses two false-twist-tubes (FTTs) (1) and (2) located directly at the delivery points of the nip point of the front rollers (3) of a drafting mechanism as shown in FIGS. 1*a* and 1*b*. The FTTs (1) and (2) are driven by a plain or toothed belt (4) FIG. 2, with the direction of the rotation of the FTTs arranged to be in any direction according to one's wish. The drafted two fibre strands (5) and (6), pass through the centre hole of the FTTs (1) and (2) respectively.

Figure 3:
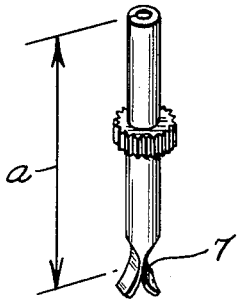
FIG. 3 is a perspective view of the false-twist-tube.

If the FTTs (1) and (2) rotate in the direction shown in FIG. 1*a*, i.e. counterclockwise, then the upper part of the fibre strands (5) and (6) that has not yet passed the nip point (7) of the FTT FIG. 3, will get the 'S' twist. If a spindle (8) FIG. 1*a*, rotates in the same direction as the FTTs, then the 'S' twist that is imposed on the fibre strands (5) and (6) will remain thereon and, therefore the final product of the ply yarn (10) will have a SS-S twist the same as conventional two ply twisted yarns. In other words, by utilizing the actual twist that exists on the upstream portion of the fibre strands (5) and (6) that is produced by the false twist tubes (1) and (2), in such case, the product has the same twist direction along its length and the same twist intensity of 'S' or 'Z' after it has been once set. This is the most important difference from the said prior publications mentioned above.

We can change the rotational speed and the direction of the FTTs (1) and/or (2), and can also change the rotational speed and the direction of the spindle (8), to any different rate and/or any combination, thus making possible many different sorts of twisted ply yarns (10) without any limit.

We can use any kind of automatic cutter operated by any means to cut off the twisted fibre strands (5) and (6) when one of them is broken.

Figure 4:
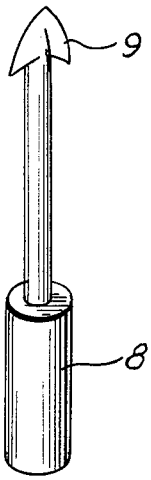
FIG. 4 is a perspective view of the arrow like top of the spindle.

As to the spindle part, an arrow like top (9) may be mounted on the spindle (8), FIG. 4, to ensure the correct function of the twisting operation. The arrow like top (9), FIG. 4, may be changed to the screwdriver type notch; type or biconical and cross head type ect. as is used on woolen yarn spinning for reducing the spinning tension.

I claim:

1. A process for producing a twist and ply twist yarn from two drafted and separated fiber strands delivered from the front rollers on the draft system of a spinning machine comprising:

(1) inducing a false twist on each of the strands to produce thereon a twist in one direction above the point where the false twist is induced and a twist in the opposite direction therebelow;

(2) removing the twist in the strands below the point where the false twist is induced to form twisted strands; and (3) twisting the two strands together to form a two ply twisted yarn having the same twist direction and twist intensity.

2. The process of claim 1 wherein the false twist in each strand is induced by rotating each strand in the same direction.

3. The process of claim 1 wherein the false twist in each strand is induced by rotating each strand in opposite directions.

4. The process of claim 1 wherein step (2) is conducted by feeding the strands to a rotating spindle.

5. The process of claim 4 wherein the spindle rotates in the same direction as the means for inducing the false twist.

6. The process of claim 4 wherein the spindle rotates in a direction opposite to that of the means for inducing the false twist.

* * * * *